United States Patent [19]

Howze

[11] 4,344,504

[45] Aug. 17, 1982

[54] DIRECTIONAL LOUDSPEAKER

[75] Inventor: Bruce Howze, Springfield, Pa.

[73] Assignee: Community Light & Sound, Inc., Philadelphia, Pa.

[21] Appl. No.: 248,504

[22] Filed: Mar. 27, 1981

[51] Int. Cl.[3] ..... G10K 11/02

[52] U.S. Cl. ..... 181/187; 181/192

[58] Field of Search ..... 181/187–192, 181/195, 144, 147, 155

[56] References Cited

U.S. PATENT DOCUMENTS

| | | | |
|---|---|---|---|
| 1,791,171 | 2/1931 | Thorington | 181/144 |
| 1,874,733 | 8/1932 | Zwikker | 181/147 |
| 2,690,231 | 9/1954 | Levy et al. | 181/192 |
| 2,872,516 | 2/1959 | Hoffman | 181/144 X |
| 3,477,540 | 11/1969 | Rizo-Patron | 181/144 X |
| 3,819,006 | 6/1974 | Westlund | 181/155 X |
| 4,071,112 | 1/1978 | Keele, Jr. | 181/187 |
| 4,187,926 | 1/1980 | Henricksen et al. | 181/192 |
| 4,280,585 | 7/1981 | Nakanishi | 181/147 |

FOREIGN PATENT DOCUMENTS

| | | | |
|---|---|---|---|
| 968490 | 2/1958 | Fed. Rep. of Germany | 181/144 |
| 327145 | 3/1930 | United Kingdom | 181/144 |

*Primary Examiner*—Joseph W. Hartary
*Assistant Examiner*—Thomas H. Tarcza
*Attorney, Agent, or Firm*—Steele, Gould & Fried

[57] ABSTRACT

A loudspeaker having uniform horizontal sound dispersion characteristics in a design angle and minimal sound dispersion vertically comprises multiple sound energy sources forming an elongated line source of sound energy, and a waveguide having an elongated input portion coextensive with the elongated line source and substantially planar side walls defining an expanding cross-section from the input portion to an exit aperture, whereby sound dispersion in a direction parallel to the line source is minimized. The waveguide expands substantially only in a direction perpendicular to the line source, the rectangular input portion having substantially the same dimension as the exit aperture measured in the direction parallel to the line source.

14 Claims, 12 Drawing Figures

DIRECTIONAL LOUDSPEAKER

BACKGROUND OF THE INVENTION

1. Field of the Invention

This invention relates to the field of loudspeakers, and especially to high powered loudspeakers, including public address systems and acoustical warning devices.

2. Description of the Prior Art

Use of a horn-like member having expanding cross-sectional area moving away from an acoustic source is well known and applicable to many environments. The general idea of such a horn is to direct the acoustical energy along the axis of the horn. Sound waves produced at the source will move outward through the horn, and upon reaching the point at which the cross-section of the horn corresponds to the wavelength at that frequency, the sound wave is directed outwards by the horn. In the range of audible frequencies, wavelengths vary greatly. For example, a minimum audible frequency of 20 Hz in atmospheric pressure (speed of sound 342 Meters second) results in a wavelength of 17.1 meters. A frequency of 20 KHz results in a wavelength of 1.7 cm. In order to accomodate the wide range of frequencies as well as dimensional limitations for practical transportation, many different speakers and horns have been devised.

Such horns, originally used to direct the energy of voices or musical instruments, evolved naturally into the electrically driven loudspeakers of today. Requirements of high efficiency and uniform projection of acoustical energy over a wide range induced those skilled in the art to develop many different theories and dimensional preferences regarding speaker horns. With regard to the efficiency of electrically driven speakers, there are two considerations to be taken into account. A first consideration involves the electrical efficiency in conversion of electrical power into acoustical power. A less obvious consideration impacting on efficiency is to confine the projected acoustical power to the field in which the listeners are located. In other words, a loudspeaker which directs power uniformly in all directions is only "efficient" if listeners are located in all directions. In the usual case, listeners are located only in a restricted field or audible range, and although environments of speakers vary widely, it is usually true that acoustical power projected widely in a vertical direction is wasted.

In the particular environment of acoustical alarm devices, such as firehouse sirens, air raid warnings and the like, wherein the warning must project several miles, wasting projected power in vertical directions is particularly unacceptable. In such devices, the optimum system would project a beam of acoustical energy horizontally, and the loudspeaker would be mounted at some position above the ground, whereby a range of persons in a horizontal window would be subjected to the alarm. Listeners concerned with the fidelity of sound reproduction at concerts and the like require not only directional control but good frequency response over the entire audible range. Accordingly, there is a need for a loudspeaker which can not only confine the projected acoustical energy to a certain plane or beam but can do so with high fidelity.

Persons skilled in the art of loudspeakers have expended substantial energy in developing directional loudspeakers in which a range of frequencies would be uniformly projected at equal power without regard to the listeners' positions within the field. This could, of course, be accomplished by use of a large number of speakers located at various positions close to each portion of the listening audience. Multicellular speakers having a large number of loudspeaker horns directed at a plurality of angles have been designed. Conversely, single loudspeaker horns have been designed which attempt to limit dispersion in certain directions. In U.S. Pat. No. 2,690,231—Levy et al, a speakerhorn is disclosed wherein a planar vertical flare close to the sound source interfaces with substantially outwardly-directed top and bottom faces approaching the aperture. In horizontal cross-section, Levy et al employs an exponentially flared horn. The Levy design is asserted to limit dispersion in a vertical or upward direction using a point source of sound energy.

U.S. Pat. No. 4,071,112—Keele, Jr. also purports to limit dispersion in the vertical direction. Similar to the design of Levy et al, Keele teaches a speaker which flares differently in the vertical and horizontal directions. Although the Keele loudspeaker expands both horizontally and vertically, the horizontal expansion is much more substantial. Finally, U.S. Pat. No. 4,187,926—Henricksen et al teaches a loudspeaker having a rectangular cross-section near the point source, longer in the vertical dimension, expanding into a substantially square aperture. The differing flares in the side walls of the loudspeaker horn are asserted to be useful to control the directivity of the speaker, and a number of options are taught whereby the designer can maximize the efficiency of sound projection at various frequencies from a point source.

The present invention has foresaken the prior art's insistence on a source of sound, and quite unexpectedly, limits vertical dispersion by utilizing a multiple driven line source which extends in the very directions in which dispersion must be limited. Although, the dispersion is still dependent to some extent on the frequency of the signal and the geometry of the speaker horn, this invention provides uniform transmission characteristics over its design horizontal coverage, independent of the frequency.

SUMMARY OF THE INVENTION

It is an object of this invention to maximize the efficiency of a loudspeaker by accomplishing the best possible control of direction and beam width of projected acoustical power.

It is also an object of this invention to provide a high power yet conveniently constructed loudspeaker for public address and applications.

It is another object of this invention to produce a loudspeaker which will readily interface with a number of different sound sources in interchangeable fashion.

It is yet another object of this invention to employ a line source of acoustical energy in order to maximize the directivity and uniformity of sound dispersion of a loudspeaker system.

These and other objects are accomplished by a directional loudspeaker having controlled planar sound dispersion characteristics, comprising multiple means for producing sound energy, said means having outlets forming an elongated line source, defining an axis of projection, of sound energy, and a waveguide having an elongated input portion corresponding to the elongated line source and side walls defining an expanding cross-section from the input portion to an exit pressure, whereby sound dispersion off said axis is minimized. The waveguide expands substantially only in a direction perpendicular to the line source, the rectangular input portion having substantially the same dimension as the exit aperture measured in the direction parallel to the line source.

BRIEF DESCRIPTION OF THE DRAWINGS

In order to illustrate the invention, there are included in the drawings forms which are presently preferred. It should be understood, however, that the invention is not limited to the precise arrangements and instrumentalities shown.

DETAILED DESCRIPTION OF THE PREFERRED EMBODIMENTS

It is necessary to limit the projected power of a loudspeaker in all directions other than toward the intended audience in order to maximize efficiency. The present invention employs an acoustical line source to achieve maximum directivity control. The orientation of the line source defines the Y-axis of a three dimensional X,Y,Z coordinate system shown in FIG. 1. For purposes of convenience, the Y-axis may be thought of as the vertical axis, with horizontal dispersion measured in the X,Z-plane and vertical dispersion measured in the Y,Z-plane. The +Z-axis may be thought of as the direction of projection. Generally speaking, the field of projection of sound energy in the horizontal direction (X,Z-plane) will be symmetrical about the Y,Z plane. It must be understood however, that as the attitude or orientation of the loudspeaker is changed, the descriptive coordinate system will change with it. The line source may also be thought of as defining an axis of projection. If the line source is thought of as lying along the Y-axis, extending from (O,−L,O) to (O,L,O), with its midpoint at (O,O,O), then all points in the coordinate system having Y coordinates greater than L or less than −L may be considered "off-axis". Within this context the object of this invention may be restated as minimizing off-axis dispersion. The particular attitude of the loudspeaker, vertical, horizontal or otherwise, is not important.

Figure 1:
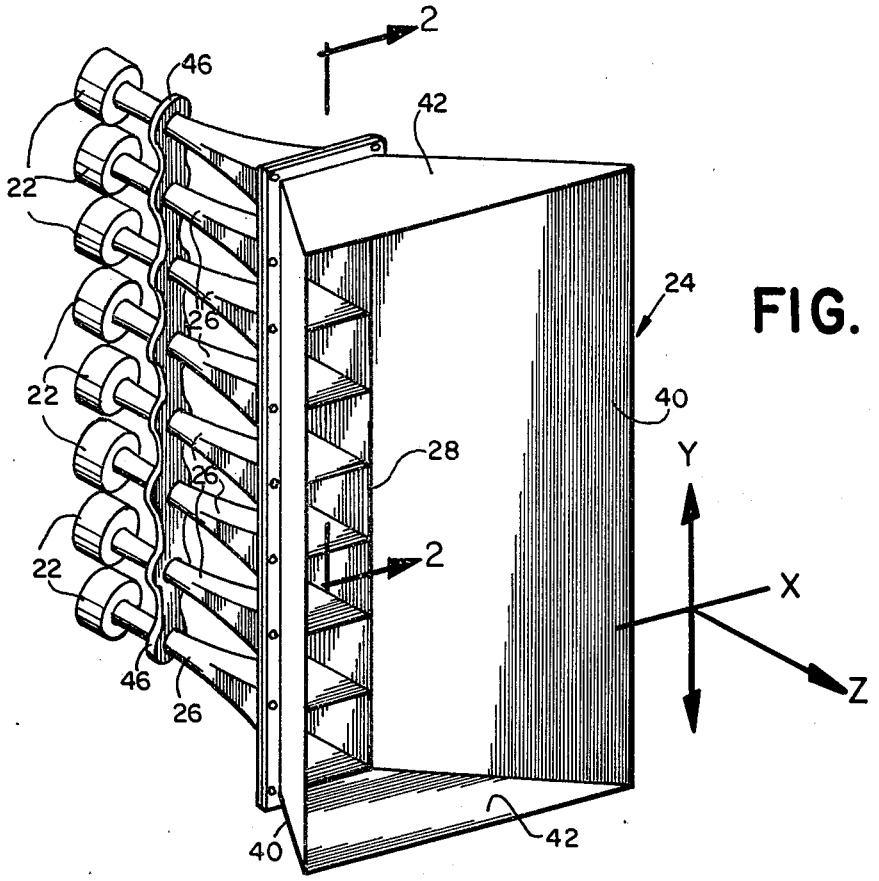
FIG. 1 is a perspective view of a preferred embodiment of the loudspeaker of this invention.

FIGS. 1 through 5 each relate to the loudspeaker apparatus shown in perspective in FIG. 1. In general, the device comprises a plurality of acoustical energy sources 22 having means for directing the acoustical energy into a waveguide 24. In the apparatus of FIG. 1, the means for directing acoustical energy from sound sources 22 to waveguide 24 are a plurality of horns 26 associated with sound sources 22. Horns 26 direct the acoustical energy into waveguide 24 along an elongated input portion 28 of the waveguide. The input portion 28 corresponds to the composite dimensions of the exit apertures of horns 26 carrying the acoustical energy from sound sources 22. Input portion 28 is thus coextensive with and parallel to the effective line source of acoustical energy produced by the plurality of signals from horns 26 and sources 22.

It will be appreciated that any type of sound source can be employed according to this invention. One suitable source is an Atlas Siren Driver, a standard air compression driver. All that is required is that a number of sound sources be used, and that their outputs be arranged in an elongated line to form a line source. In the embodiment of FIG. 1, sound sources 22 are depicted as common air compression drivers, and horns 26 as the usual exponential horn attached thereto. In order to additionally secure the attachment of horns 26 to waveguide 24 from their relatively large weight and loosening due to vibration, structural supporting member 46 is provided toward the rear of the horns. Support member 46 also helps position the horns of the multiple sound sources with respect to one another, and may comprise fiberglass straps cured in situ, perforated metal straps attached by rivets or screws, a single strap attached by "U" bolts, or any other convenient means of attachment. Such a structural support is preferred.

Figure 2:
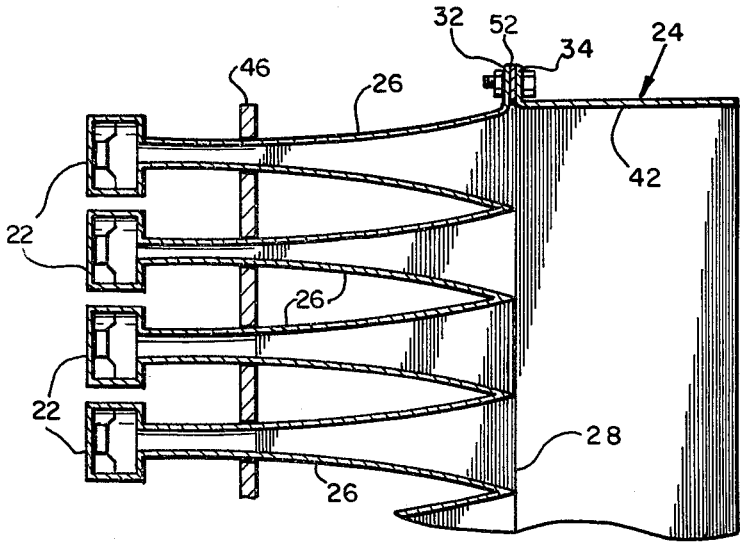
FIG. 2 is a partial cross-sectional view of the apparatus of FIG. 1, taken along line 2—2 in FIG. 1.

Toward the rear of waveguide 24 at waveguide input portion 28, horns 26 are rigidly attached as close together as practicable to waveguide 24. The particulars of one method of attachment are illustrated in FIG. 2. The composite member made up of integrally constructed horns 26 is provided with an outwardly extending peripheral flange 32. Flanges 32 are attached to waveguide 24, for example, by bolts 34. A resilient gasket 52 cushions waveguide 24 from mechanical and/or acoustical vibrations transmitted through horns 26 or from source 22 and seals the connection against acoustical energy leaks.

It is presently preferred that horns 26 be integrally molded together and thereafter attached as a single unit to waveguide 24. Alternative attachments of the horns and waveguide are possible. For example, integral or unitary horns 26 having extending flanges 32 may be removed from sound sources 22 and inserted into waveguide 24 from the front. By this method, horn 26 is partially supported within the slot at the rear of waveguide 24. Where the horns are molded as a unit, flanges between horns are omitted to provide closely arranged horn outputs. The particular means of attachment are not important to the concept of this invention, which is concerned with the geometry of the respective parts and their positioning relative to one another.

It will be noted from FIG. 2 that waveguide ends 42 flare slightly from the axis of projection. Notwithstanding the fact that dispersion in the Y axis direction is intended to be minimized, a slight flare, for example, 1–2 degrees, is preferred in order to avoid maintaining a standing wave between the respective ends 42 of waveguide 24. In addition, a waveguide 24 having a slight flare at ends 42 is somewhat easier to mold in fiberglass or plastic.

Figure 3:
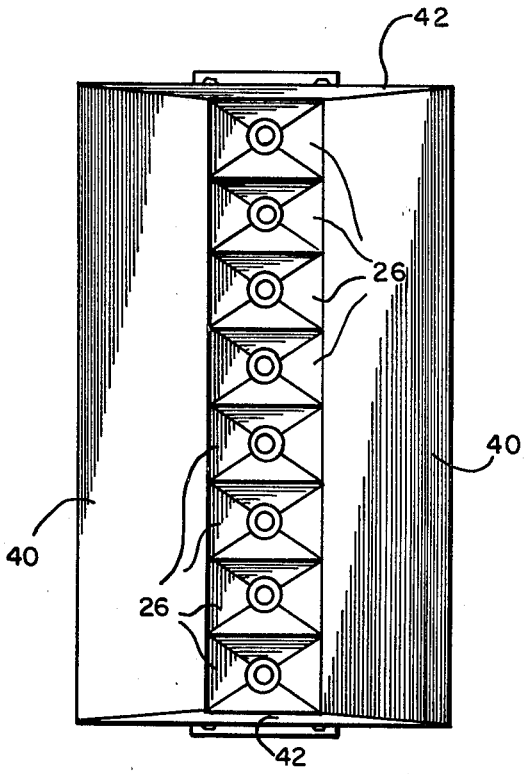
FIG. 3 is a front elevation of the apparatus of FIG. 1.

FIG. 3 is a front view of the device of FIG. 1, looking backwards into the direction of sound projection. Waveguide sides 40 are substantially more flared than waveguide ends 42. The angle of flare of waveguide sides 40 will control the X-axis dispersion of the radiated sound energy. While there are implications regarding the dimensions of such flare, particularly its effect on performance as a function of frequency, it may generally be said that the wider the flare of sides 40, the wider the angle of dispersion along the X axis. In a loudspeaker, the choice of angle will depend on the X axis beam width desired. For example, a stationary loudspeaker would require a wide beam, while a rotatable loudspeaker would require a narrow beam. This can be adjusted within certain limits by choice of the flare of sides 40.

In order to provide a line source of acoustical energy, the exit apertures of horns 26 should be attached as closely as possible to one another along the line. In a preferred embodiment, horns 26 are molded as a unit which is then attached to waveguide 24 by convenient means of attachment 48 mounted in waveguide input portion 28. In this embodiment, pictured in FIG. 3, waveguide input portion 28 comprises a rectangular hole or elongated slot 36 in the rear member of waveguide 24, the horns being attached, for example by bolting, to waveguide 24 at the sides of input portion 28, and attached integrally to one another at their extreme ends opposite sound sources 22. The attachment of horns 32 one to another may also be accomplished by heat bonding or gluing, or direct attachment between horns 26 may be omitted, the horns being correctly positioned by their attachment to waveguide input portion 28 alone. To achieve the closest possible proximity of horns, and to prevent leakage, integral construction is preferred.

Figure 4:
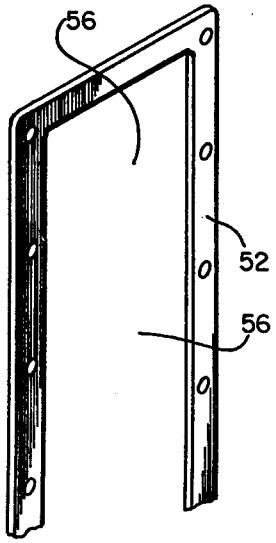
FIG. 4 is a partial perspective view of the resilient gasket mounted between the sound source horns and the waveguide of the apparatus of FIG. 1.
Figure 5:
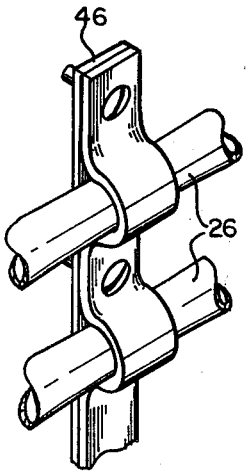
FIG. 5 is a partial perspective view of an alternative reinforcing means for the sound source horns of the device of FIG. 1.

FIGS. 4 and 5 illustrate details of the interconnection of the horns and the waveguide. In FIG. 4, resilient gasket 52 is shown in a cutaway perspective view. Gasket 52 conforms to the X axis dimensions of the horns 26 and waveguide input portion 28, between which it is attached by means of fasteners 48 extending therethrough and also supporting the horn member. Rectangular hole 56 is dimensioned to rest the resilient material of gasket 52 against the flanges 32 along the sides of horns 26, and to confine the greater part of mechanical vibration in the sound sources 22 and horns 26 to the source thereof. FIG. 5 illustrates an alternative connection between horns 26. In order to provide structural integrity, and also to confine vibration, support straps 46 attach the ends of horns 26 extending behind waveguide 24. As an alternative to a one-piece molded horn unit, the straps may conveniently be perforated metal straps attached by screws or rivets, or, a metal strap may be combined with a resilient strap in order to accomodate any vibration in horns 26.

The present invention is remarkably different than multicellular horn arrangements heretofore known. The usual multicellular arrangement employs a plurality of independent speakers each aimed at a certain field, the performance of the individual speakers may be controlled and the total result is a relatively uniform distribution of power across the field and over a range of frequencies. In the apparatus of this invention, the use of multiple horns is not merely to add their signals, and in fact, a gain in directivity is realized that is unexpected in view of the poorer directivity of individual horns. Moreover, the use of the exponentially flared horns 26 is preferred in order to properly load sound sources 22 to achieve full electrical efficiency, especially at low frequencies. Any sound sources will achieve the foregoing result, provided the outputs of such sources are positioned to form an elongated line source according to this invention.

The respective angles and dimensions of waveguide 24 are dependent on the frequencies at which the device will be used. In order to control the sound pattern or beam angle with a straight-sided waveguide whose included angle is $\theta$ from high frequency $f_{hi}$ to low frequency $f_{lo}$, the following must be true: The minimum dimension across the exit aperture of the waveguide must be Wm, per the following relationship:

$$Wm > \frac{90C}{\theta f_{lo}}$$

The maximum dimension across the input portion of the waveguide, such as slot 36, Wt, must be:

$$Wt < \frac{90C}{\theta f_{hi}}$$

C is the speed of sound in air, namely 342 meters/-second. In addition, the flare angles of the waveguide will govern the width of the acoustical beam which is projected therefrom. Typically the beam width is defined on either side of the beam by a 6 dB drop in power.

In the present invention, with respect to the Y axis measurements, the maximum dimension across the input portion of the waveguide is essentially the same of the length of the line source. At frequencies above $f_{hi}$, the beam width projected will become narrower than the included angle of the waveguide, and at frequencies below $f_{lo}$, the beam width will become wider.

If the longer dimension (i.e., the Y axis dimension or the length of the line source) is "L", then the approximate angle of dispersion in the direction parallel to the line source (i.e., the Y axis) at a frequency "F" will be $$\frac{(90)\,(C)}{(L)\,(F)}.$$

It will be noted that this angle varies directly as a function of frequency, and further that the angle varies directly as a function of line source length.

Assuming an X axis pattern of 45° is desired, over a frequency range from 800 Hz to 3 KHz, the maximum dimension across the input portion of the waveguide calculates out to be less than or equal to $$\frac{(90)\,(C)}{(\theta)\,(f_{hi})},$$

or, 0.23 M. Similarly, the minimum dimension across the aperture of the waveguide must be greater than or equal to $$\frac{(90)\,(C)}{(\theta)\,(f_{lo})},$$

or, 0.85 M.

It will be appreciated that a longer line source will provide increased directivity along the Y-axis directions. Still using the above example, but using the Y axis dispersion, defined as being equal to $$\frac{(90)\,(C)}{(Lgt)\,(F)},$$

and solving for beam angle theta, a line source length of 1.5 M at 3 KHz results in a beam dispersion in the Y axis direction of approximately 7°. Since the angle varies in an inversely proportional relationship to both the length of the line source and the frequency, achieving the same result at 300 Hz requires a line source 15 M long.

It has been discovered that in order to achieve the full benefits of the line source in the usual high powered loudspeaker, that the line source length should exceed the widest dimension at the mouth of the waveguide by at least 2:1.

In experimental tests, a number of air compression drivers were mounted on a waveguide as pictured in FIG. 1, and driven using a square wave siren signal at 800 Hz, at 125 watts per driver. The structure was mounted on a tower at 40 feet above the ground (along the Y axis) and the sound level was measured at 100 feet from the tower (along the Z axis). Using 16 such drivers (2000 watts), with a line source length of approximately 96 inches and a maximum waveguide width of 24 inches (along the X axis), a sound level of 127 dBA was measured. Using eight such speakers (i.e., a four foot line source) at 125 watts per driver, a sound level of 123 dB was measured. By way of comparison, a test using four drivers having conventional reentrant horns arranged in a vertical stack and pointed along the Z-axis, provided a sound level of only 115 dB. Since 3 dB implies a difference of half power, one would expect to observe a 3 dBA difference between each test because four, eight, and sixteen equally powered drivers were used, respectively. In accordance with this invention, using a line source of acoustic power, a difference of 4 dB was observed between eight and sixteen drivers, namely, the expected 3 dB plus 1 dB for lost vertical directivity due to a shorter line source. Using the aforesaid four drivers and no waveguide, which arrangement can be deemed similar to the multicellular arrangements of the prior art, a difference of eight dB was observed, i.e., substantially less than one-quarter power. Since an effective line source was no longer being employed, a larger proportion of the acoustical power was projected off axis and wasted.

Figure 6:
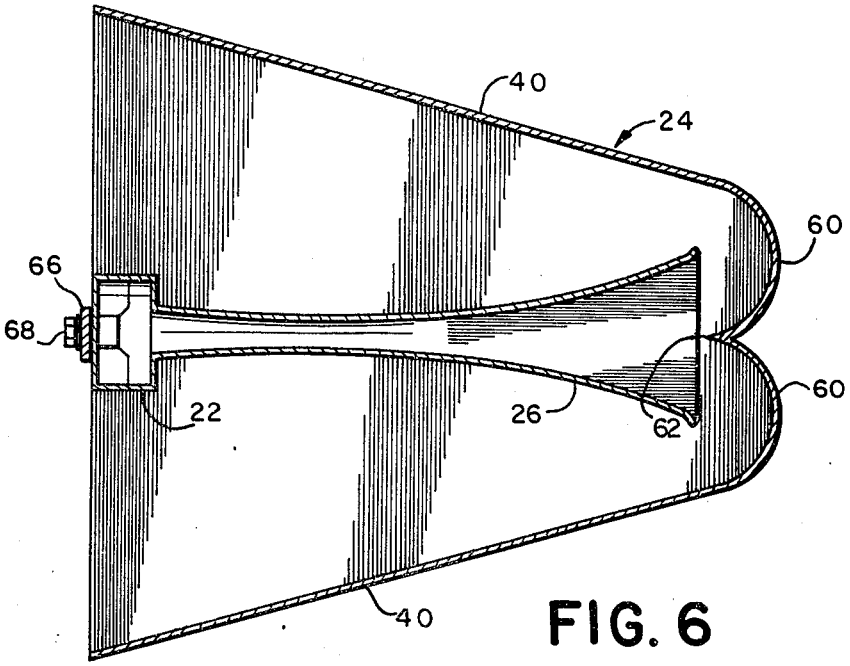
FIG. 6 is a section view of the loudspeaker of this invention, embodied in a re-entrant horn configuration.

The present invention is applicable to a wide range of devices for projection of acoustic power. With reference to FIG. 6, re-entrant horn arrangements are advantageous for this invention. The re-entrant embodiment of FIG. 6 disposes sound sources 22 at the waveguide aperture. The input portion comprises a reflector 60 directing the acoustic energy back over the horn 26 mounted in the waveguide 24. Such re-entrant devices are compact and effective. A ridge 62 running along the Y-axis directs the output from the plurality of horns 26 back into waveguide 24. Horns 26 are mounted backwards with respect to the axis of projection, nevertheless forming an effective line source just before ridge 62. Sound sources 22 are mounted, for example on bracket 66, by any convenient means, such as bolts 68.

Figure 9:
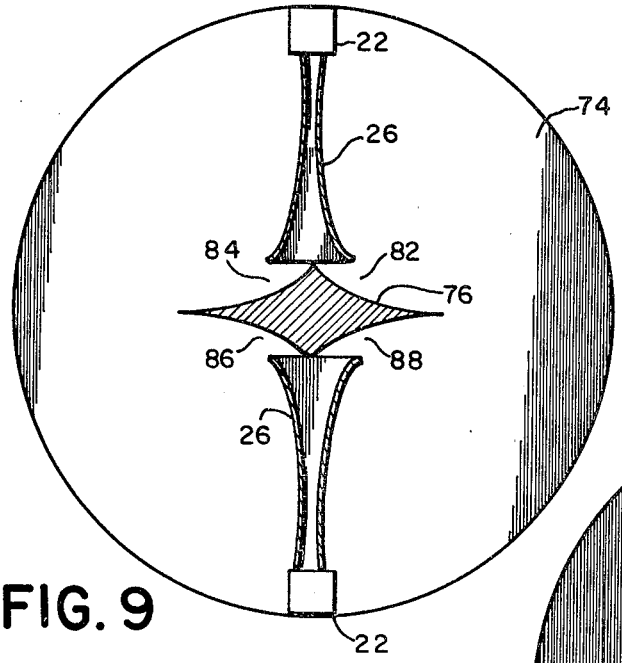
FIG. 9 is an alternative embodiment of the device of FIG. 7, also taken along section lines 8—8 in FIG. 7.
Figure 8:
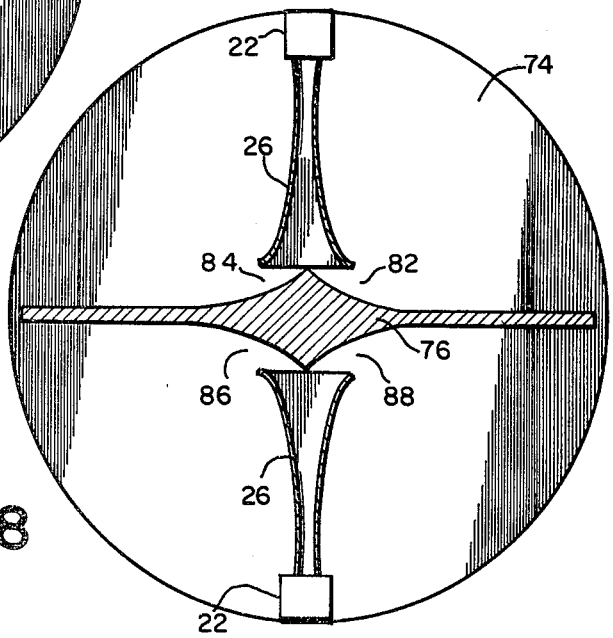
FIG. 8 is a cross-section view of the apparatus of FIG. 7, taken along lines 8—8 in FIG. 7.
Figure 7:
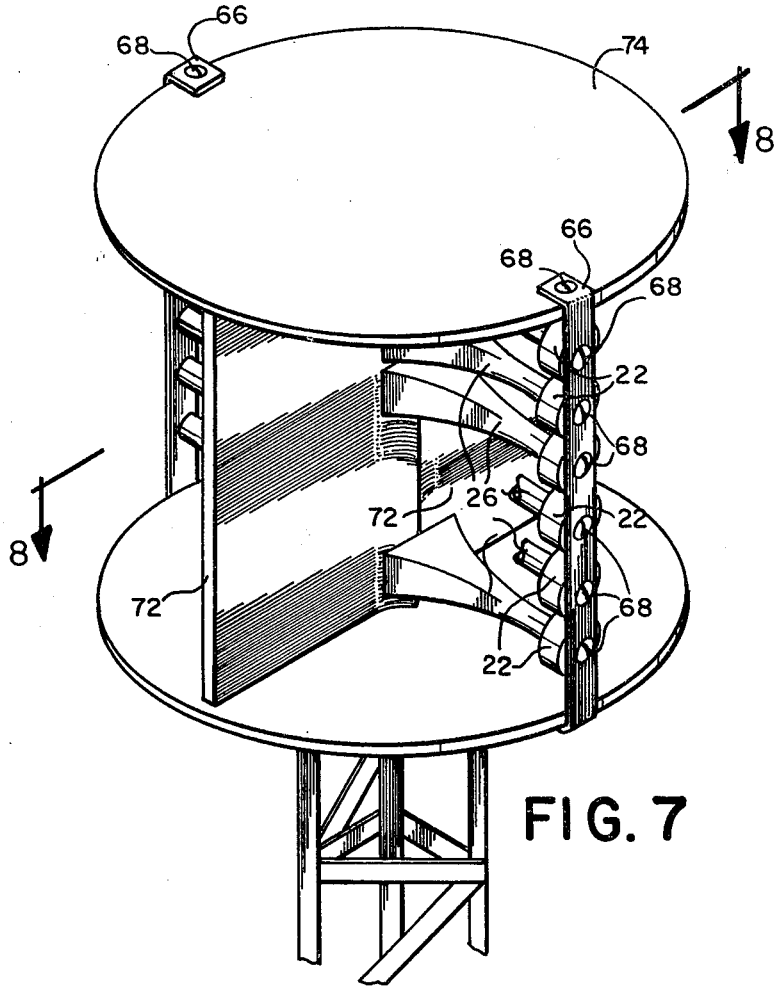
FIG. 7 is a perspective view of the apparatus of this invention configured for a 360° horizontally directed beam.

FIGS. 7 through 9 illustrate additional re-entrant configurations. In FIG. 7, as in the foregoing figures, a plurality of sound sources and horns are mounted along an elongated line forming a line source of acoustical power. Similar to the device of FIG. 6, the loudspeaker system of FIG. 7 directs the sound power against reflectors shaped to direct the sound energy back out over the horn and sound source. In FIG. 7, however, the waveguide is open to 180°. Deflector side 72 and deflector ends 74 in FIG. 7 correspond to waveguide sides 40 and waveguide ends 42 in FIGS. 1–3. An additional row of sound sources and horns are provided on the side of deflector 72 behind that pictured in FIG. 7. Reference may be made to FIG. 8, showing the device in cross-section along line 8—8 in FIG. 7.

In FIG. 8, the input portion comprises an acoustic plug 76, shaped to complement the apertures of horns 26, directs the acoustical power from source 22 out and away from the loudspeaker system. Inasmuch as sound is directed from a line of sound sources and horns on either side of division 72, and since acoustic plug 76 divides the signal and directs the same over a full 180° on each side, there are two line sources in this embodiment each directed into a 180° waveguide. Accordingly, using a single apparatus having the depicted two rows of sound sources, a 360° coverage is accomplished, with minimal dispersion in the Y axis direction. The two line sources cover quadrants 82, 84, 86, 88 with a highly directional (on axis) 360° beam, well suited to high-powered alarm applications.

A like result is accomplished by a variation on the apparatus of FIG. 8, as shown in FIG. 9. In a system of 360° coverage, the waveguide 72 of FIG. 8, corresponding to waveguide 24 in FIGS. 1 and 6, is not entirely necessary. In FIG. 8, the waveguide is primarily a structural support rather than a means of limiting X axis dispersion (which is 360° anyway). Since there is no need to confine the projected acoustical power along an X axis, a smaller acoustical plug 76 is adequate to direct the two line sources of acoustical energy into quadrants 82, 84, 86, 88. Moreover, the arrangement prevents two nulls which otherwise could occur at the angular positions of the ends of deflector 72.

Figure 10:
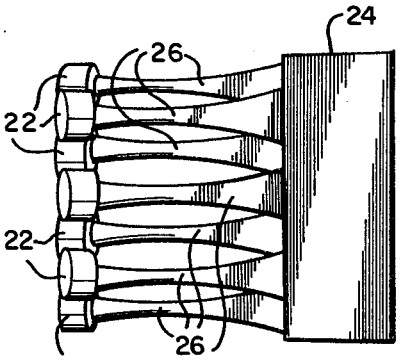
FIG. 10 is a side elevation of an alternative embodiment of this invention.
Figure 11:
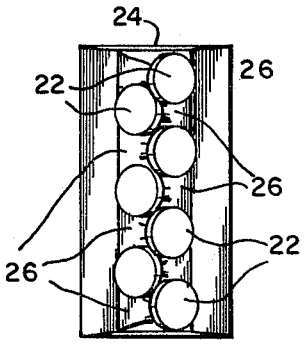
FIG. 11 is an end elevation view of the device of FIG. 10.
Figure 12:
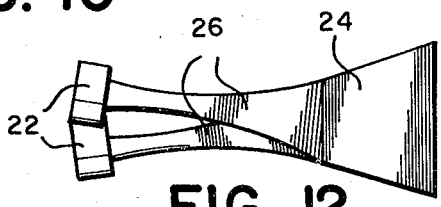
FIG. 12 is a top plan view of the device of FIG. 10.

FIGS. 10 through 12 demonstrate yet another variation on the inventive concept. In order to provide a high-powered as well as directionally discriminating loudspeaker device, it is necessary to either use very high-powered sound sources, or to use a large number thereof. Convenience requires that this be done in a relatively small space. As described hereinabove, the relative dimensions of width and height impact on the efficiency of the loudspeaker system due to geometrical considerations. Notwithstanding the efficiency of the unit, it will also be appreciated that a higher powered alarm will generate a longer reaching and more effective signal. In accordance with this invention, multiple sound sources 22 may be staggered to form a line source of acoustic energy, thereby resulting in a higher powered device per unit of line source length. In addition to the gains in efficiency due to directional precision, such a device is high-powered and quite effective as an alarm. As shown in FIG. 10, the device is configured similarly to that of FIG. 1. Sound sources 22 and horns 26 are mounted behind wave guide 24 and form a line source of acoustical power. With reference to FIG. 11, the line source is formed by the staggered series of horns 26 disposed at wave guide input portion 28. Wave guide 24 is shown with a slight flare in the X axis direction, however, it will be appreciated that the flare chosen for the X axis direction will depend on the particular use (i.e. X-axis dispersion requirements) contemplated.

FIG. 12 depicts the top plan view of the device of FIG. 10. Sound sources 22 are staggered in relation to one another, and horns 26 are cut slightly off perpendicular to their axis in order to fit tightly against the input portion of wave guide 24.

The use of additional flared flange portions disposed at the exit aperture of the waveguide to further control directivity is taught in U.S. Pat. Nos. 4,071,112 and 4,187,926. Such additional flared flange portions may be utilized with loudspeakers according to this invention without altering the controlled dispersion characteristics.

Many other variations on this invention are possible and will now be apparent to those skilled in the art. Reference should be made to the appended claims, rather than the foregoing specification, as indicating the true scope of this invention.

I claim:

1. A loudspeaker, having controlled planar sound dispersion characteristics, comprising:

a plurality of individual electroacoustical drivers, having horns expanding in cross-section, said horns having exit apertures aligned and joined to form an elongated line source, defining an axis of projection for sound energy; and, a waveguide having an elongated input portion corresponding to and parallel with said line source and side walls defining an expanding cross-section from said input portion to an exit aperture of said waveguide, whereby sound dispersion off said axis is minimized.

2. A loudspeaker according to claim 1, wherein said line source and input portion correspond in length and width.

3. A loudspeaker according to claim 1, wherein said waveguide cross-section expands substantially only in one dimension.

4. A loudspeaker according to claims 1 or 3, wherein said waveguide cross-section expands substantially only perpendicularly to said projection axis.

5. A loudspeaker according to claim 1, wherein said plurality of drivers are disposed within said waveguide, forming a re-entrant configuration.

6. A loudspeaker according to claim 5, wherein said input portion comprises a bilateral sound wave deflector having curved surfaces.

7. A loudspeaker according to claim 1, wherein said plurality of drivers are disposed outside of said waveguide.

8. A loudspeaker according to claim 7, wherein said input portion comprises an elongated slot.

9. A loudspeaker according to claim 8, wherein said line source comprises structure defining a composite rectangular line source aperture sealably connected to said input portion.

10. A loudspeaker according to claim 9, wherein said line source aperture structure and said input portion include a flange for respective attachment and a sealing gasket.

11. A loudspeaker according to claim 1, wherein said waveguide cross-section is rectangular, having a major axis parallel to said line source and a minor axis perpendicular thereto, said major axis being sufficiently longer than said minor axis to preclude effective sound propagation in directions parallel to said major axis.

12. A loudspeaker according to claim 11, wherein a ratio of length of said projection axis to said minor axis of said waveguide cross-section is at least approximately 2:1.

13. A loudspeaker according to claim 12, wherein said ratio is approximately 2:1.

14. A loudspeaker according to claim 1, wherein said cross-sections of said horns expand exponentially.

* * * * *